US005180222A

United States Patent [19]

Robinson

[11] Patent Number: 5,180,222

[45] Date of Patent: Jan. 19, 1993

[54] CABINET ALLOWING OBJECT TO BE VIEWED FROM MULTIPLE ANGLES

[76] Inventor: Douglas J. Robinson, 1649 Kalorama Rd., N.W., Washington, D.C. 20009

[21] Appl. No.: 788,370

[22] Filed: Nov. 6, 1991

[51] Int. Cl.[5] ..... A47F 11/10

[52] U.S. Cl. ..... 362/125; 362/298; 312/223.5

[58] Field of Search ..... 362/125, 133, 298, 300, 362/301, 806, 811; 312/223, 224, 225, 226, 227

[56] References Cited

U.S. PATENT DOCUMENTS

| | | | |
|---|---|---|---|
| 630,652 | 8/1899 | Buck . | |
| 749,678 | 1/1904 | Jefferson . | |
| 1,110,296 | 9/1914 | Wiley | 359/616 |
| 1,547,817 | 7/1925 | Mahoney . | |
| 2,430,318 | 11/1947 | Zimmerman . | |
| 2,454,577 | 11/1948 | Smith . | |
| 3,610,918 | 10/1971 | Barlow | 362/811 |
| 3,790,772 | 2/1974 | Newman et al. | 362/811 |
| 3,811,041 | 5/1974 | Matsushita | 362/811 |
| 4,139,955 | 2/1979 | Reiback | 362/811 |
| 5,040,102 | 8/1991 | Bengert | 362/125 |

*Primary Examiner*—Richard R. Cole

*Attorney, Agent, or Firm*—Mason, Fenwick & Lawrence

[57] ABSTRACT

The present invention provides a display cabinet for displaying an object from a plurality of views, in which the observer's own image is not reflected. According to the present invention, at least one reflective surface such as mirrors are provided within a cabinet. The mirrors define an internal display chamber within the cabinet, with one of the faces of the display chamber constituting a viewing window having a special coating which allows some of the interior light to escape the display chamber. The lighting in the display chamber is controlled so as to ensure that more light exits the viewing window than enters from outside the display cabinet, thus ensuring that the observer's image is not reflected.

14 Claims, 1 Drawing Sheet

CABINET ALLOWING OBJECT TO BE VIEWED FROM MULTIPLE ANGLES

BACKGROUND OF THE INVENTION

1. Field of the Invention

The present invention relates to display cabinets. More particularly, the invention relates to display cabinets in which an object may be viewed from several angles through use of reflective surfaces, while the viewer does not see his own reflection.

2. Related Art

Cabinets for the display of objects are known in the art. Often, these cabinets are made based on the principles of kaleidoscopes, having internal mirrors allowing multiple reflections of light.

As a background, U.S. Pat. No. 2,430,318 (Zimmerman) discloses a kaleidoscopic toy having two mirrors and a bright object within a box. U.S. Pat. Nos. 1,547,817 (Mahoney) and 2,454,577 (Smith) also disclose kaleidoscopes for amusement purposes. U.S. Pat. No. 630,652 (Buck) discloses a kaleidoscope having three interior mirrors, one of the mirrors having an opening to allow a viewer to see objects in the space defined by the three mirrors.

In the field of display cabinets, U.S. Pat. No. 1,110,296 (Wiley) discloses a display apparatus having mirrors with adjustable intersecting angles, with top and bottom lighting. U.S. Pat. No. 749,678 (Jefferson) discloses a show window having transparent glass windows and one or more reflective mirrors within a case.

These patents are incorporated herein by reference as if reproduced in full below.

Unfortunately, the known display devices have shortcomings which limit their usefulness. Often, the devices for displaying objects allow the observer's own image to be visible in the background, a characteristic which is generally undesirable. Further, attempts to allow multiple views of objects such as that in the Buck patent have often limited the viewer to a very small "peephole". This "peephole" limits the observer's ability to comprehensively view the object from a variety of continuously variable angles, and effectively prevents more than one observer from viewing the interior simultaneously. Moreover, many of the known display systems have occupied more space than is desirable, due to their "boxy" construction. Finally, many known display cabinets have been aesthetically displeasing in shape. These shortcomings have long existed in the art, despite the long history and variety of such display devices.

Therefore, there is a need in the art to provide a display cabinet for objects allowing the objects to be viewed from a plurality of angles simultaneously, preferably allowing one or more observers to view the object along a continuous series of angles of observation. Further, it is desirable to provide such a display cabinet in which the observer's own image is not reflected. Finally, it is desirable that such a cabinet occupy minimum physical space.

SUMMARY OF THE INVENTION

The present invention overcomes the shortcomings of known systems.

The present invention provides a display cabinet for displaying an object from a plurality of views, in which the observer's own image is not reflected back toward him. According to the present invention, at least one reflective surface such as a mirror is provided within a cabinet. The reflective surface(s) define an internal display chamber within the cabinet, one of the faces of the display chamber constituting a viewing window having a special coating which allows some of the interior light to escape the display chamber. The lighting in the display chamber is controlled so as to ensure that more light exits the viewing window than enters from outside the display cabinet, thus ensuring that the observer's image is not visible in the reflective surfaces in the display chamber.

Thus, according to the present invention, a large viewing window may be provided, still allowing the object within the display chamber to be viewed from a variety of angles as defined by the orientation of the plurality of reflective surfaces. A variety of lighting arrangements are contemplated, ensuring that the object may be illuminated as desired. Further, a locking device may be used to secure valuable objects within the display chamber. The invention allows considerable space savings, while providing a convenient wide-angle viewing ability for several observers simultaneously.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
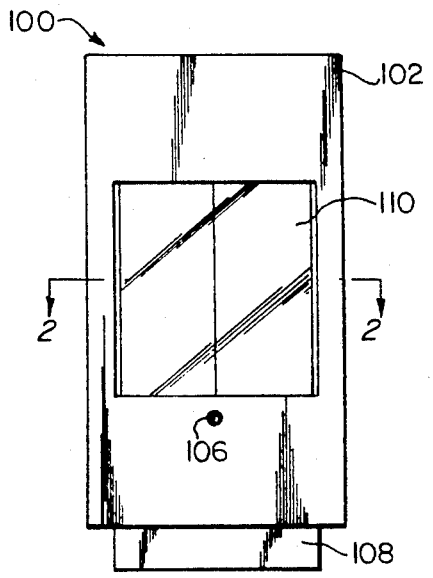
FIG. 1 is a front elevation view showing a preferred embodiment of the display cabinet according to the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose. For example, "top", "bottom", "left", "right", "above", "below", "upper", "lower", and so forth, are presented for ease of reference in describing a particular embodiment, and do not limit the scope of the invention in any way.

Figure 2:
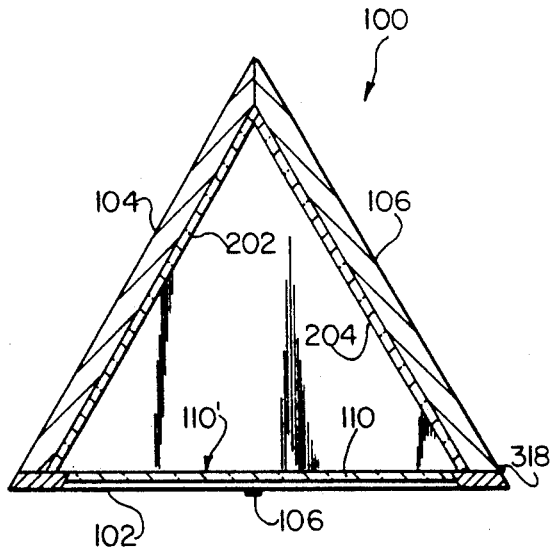
FIG. 2 is a top sectional view along the lines 2—2 of FIG. 1.
Figure 3:
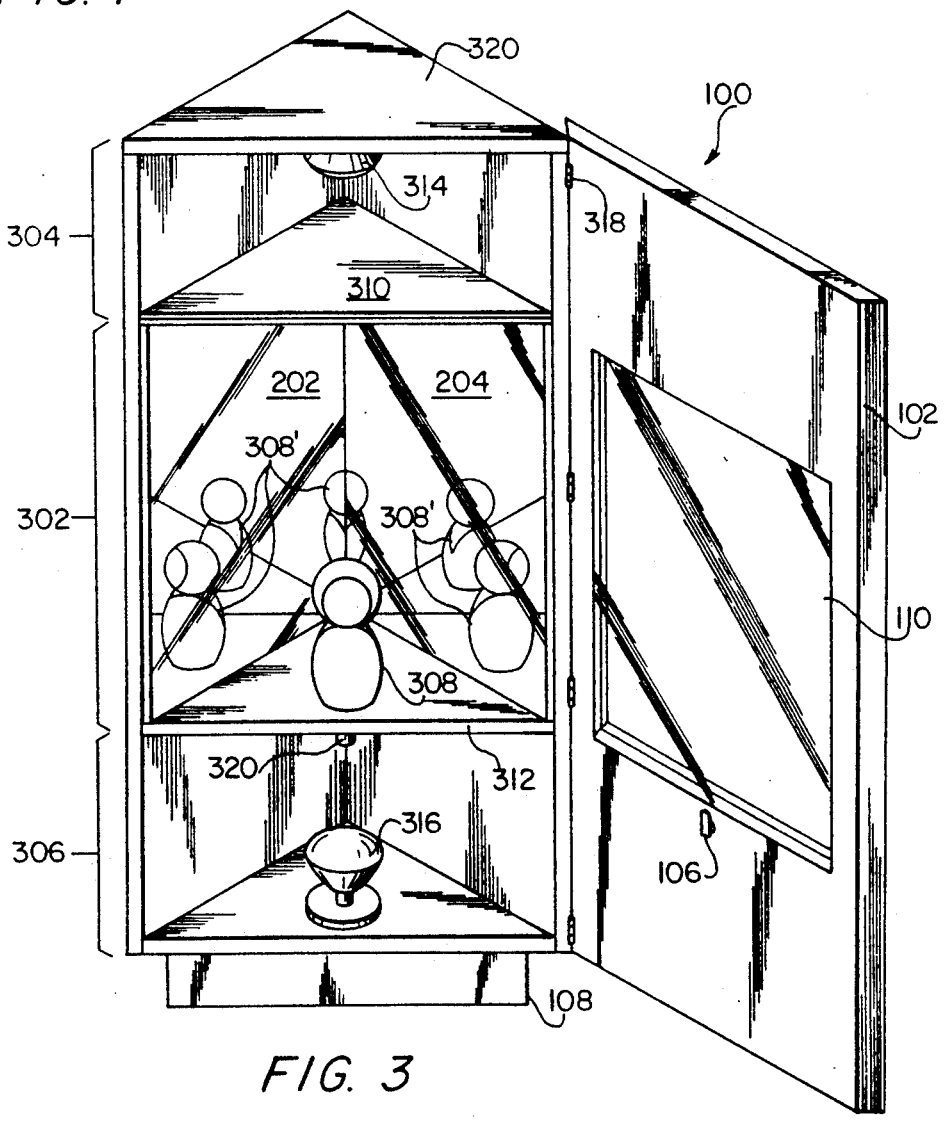
FIG. 3 is a front perspective view of the preferred display cabinet, with the front door open to show the various chambers in the cabinet.

A preferred embodiment of the display cabinet according to the present invention is shown in FIGS. 1-3. The cabinet includes a front door 102 and left and right cabinet side panels 104, 106, respectively. Door 102 and side panels 104, 106 are vertically arranged to form an interior space in the shape of an equilateral triangular prism. The cabinet is situated between a base 108 (FIG. 1) and a top surface 320 (FIG. 3). A rectangular viewing window 110 is provided in door 102.

As shown most clearly in FIG. 2, the "footprint" of the cabinet is triangular. In the interior of the cabinet, reflective glass or mirrors 202, 204 are provided on inner surfaces of cabinet panels 104, 106, respectively. The third side of the interior of the cabinet comprises the inner surface of door 102. The inner surface of glass viewing window 110 is covered by a semi-reflective coating, labelled 110'. The window preferably constitutes a "half-mirror". As used in the present specification, the term "half-mirror" means a surface which reflects only a portion of incident light but transmits the remainder of it. No implication is made by the term "half"-mirror or "semi"-reflective that exactly 50% of the light is transmitted.

In this arrangement, light in the interior of the cabinet may repeatedly reflect among reflective surfaces 202, 204, and 110'. However, some of the light escapes through semi-reflective coating 110, so that the interior of the cabinet can be viewed by an observer. The invention achieves some of its utility by design of the half-mirror's properties, and through choice of interior and exterior light intensities. When the interior light is more intense than exterior light the outside observer cannot see his own image reflected by reflective surfaces 202, 204 nor in viewing window 110. In short, the observer does not see his own reflection when viewing the interior of the cabinet.

Referring now more specifically to FIG. 3, the cabinet is shown to comprise a display chamber 302 disposed between an upper chamber 304 and a lower chamber 306. An exemplary object 308 is shown placed in the display chamber 302, multiple reflections 308' of the object being shown in reflective surfaces 202, 204.

The display chamber 302 is separated from the upper chamber 304 by an upper divider 310. Similarly, the display chamber 302 is separated from lower chamber 306 by a lower divider 312. Upper and lower dividers 310, 312 are made from a material or are made in a form which transmits, and preferably also diffuses, light. In the illustrated embodiment, a top light source 314 and a bottom light source 316 are provided in respective upper and lower chambers 304, 306. Preferably, dividers 310, 312 are planar translucent material, serving to diffuse light from light sources 314, 316 to surround object 308 with light so as to minimize harsh shadows. However, dividers 310, 312 may also be designed as lenses or baffles. The dimensions of viewing window 110 are preferably maximized to allow one or more observers to view as much as possible of the display chamber 302, as defined by the edges of the door 102 and the upper and lower dividers 310, 312.

As illustrated in FIG. 3, door 102 is rotatably affixed to the right side of the cabinet by hinges 318. Security for the cabinet may be provided by means of a conventional lock 106 centered beneath the viewing window 110. Lock 106 may selectively engage a conventional catch 320 centered on the bottom front edge of lower divider 312.

Various features known to those skilled in the art have been omitted from the drawings for the sake of clarity.

For example, it is well known to those skilled in the art that electrical wiring and electrical switches may be readily provided to supply power to top and bottom light sources 314, 316 and to enable simultaneous, independent, or variable-brightness switching of top and bottom light sources 314, 316. The switches may advantageously be provided in lower chamber 306, near the source of electrical power. Wiring to provide power to the upper light source 314 may be routed behind reflective glass or mirror surfaces 202, 204.

Ventilation slots or holes may be provided in top surface 320 or on the back of the cabinet on cabinet panels 104, 106. Such slots or holes may be provided in the front of door 102, although this is generally thought to be less desirable for aesthetic reasons. Further, it will readily be appreciated that lower chamber 306 may be used for storage purposes, perhaps for storing additional objects to complement object 308. Lock 106 provides the same level of security for objects in lower chamber 306 as for the displayed object 308.

It will further be readily appreciated that cabinet side panels 104, 106, as well as the cabinet front door 102, may be made of any suitable material, such as wood, plastic, metal, particle board, or fiberboard. Surfaces 202, 204 may be mirrors or reflective glass.

Alternatively, surfaces 202, 204 may be "one-way mirrors" allowing lights supplemental to 314, 316 to be placed between surfaces 202, 204 and cabinet panels 104, 106. In this alternative embodiment, a suitable chamber is provided between 202 and 104, and/or between 204 and 106.

The reflective coating on the inside surface of viewing window 110 may be any suitable material which reflects some light and passes other light, such as "SOLARBAN" from PPG Industries, Inc. of 501 Second Avenue, Ford City, Pa. 16226. The choice of reflective coating is made in conjunction with the choice of top and bottom light sources 314, 316. As appreciated by those skilled in the art, an observer outside the cabinet looking into the cabinet through viewing window 110 will readily see the object 308 and object's reflection 308' only if the light intensity inside the cabinet is greater than the ambient light level. Thus, light sources 314, 316 are generally bright lights, such as Halogen "PERFORMANCE PLUS" from General Electric Company of Nela Park, Cleveland, Ohio 44112.

Also, the viewing window 110 may be made of laminated, impact-resistant glass so as to protect the contents of the cabinet. The glass may even be made bulletproof, if required.

For still further security, the semi-reflective coating allows the object 308 to be hidden from view when the internal light sources 314, 316 are turned off. In this case, the viewing window 110 appears to be a normal mirror, reflecting ambient light back to the viewer, and obscuring the interior of the cabinet. This obscuring of the cabinet interior tends to thwart attempts at theft or vandalism.

The upper and lower dividers 310, 312 may be made of a translucent material such as "PRISM PANELS" by Artcrest Products, Inc. of 500 W. Cermak Road, Chicago, Ill. 60616. Alternatively, the dividers may be open louvers such as "PARAHEX" by Artcrest Products, Inc. of 500 W. Cermak Road, Chicago, Ill. 60616.

Of course, many variations upon the illustrated embodiment may be practiced, while still remaining within the scope of the invention.

For example, the three-sided configuration (two reflective surfaces and one half-mirror) may be replaced by a different number of reflective surfaces and a greater number of half-mirrors. These variations allow different optical effects to be experienced.

Similarly, the upper chamber 304 or the lower chamber 306 may be eliminated, or the internal lighting provided by only one of the light sources 314 or 316. Alternatively, one or both of the light sources, or one or both of the upper or lower chambers, may be eliminated altogether, and one or more light sources placed at the same height as the displayed objects, illuminating the objects through "one-way mirrors" as described above.

The illustrated embodiment provides the advantage of saving floor space; however, by eliminating upper and lower chambers 304, 306, and placing light sources horizontally across from the objects in a new side chamber (not illustrated), vertical space is conserved.

Further, the optical qualities of upper divider 310 and lower divider 312 may be other than those provided by a translucent plane. For example, one or the other divider may be opaque or totally reflective.

In the preferred embodiment, the cabinet is 36 inches high, not including a 3 inch high base. Front door 102 is 16 inches wide, supporting a viewing window which is 12 inches wide and 12 inches high. Of course, variations on the structure, materials, orientation, and dimensions of the elements of the illustrated embodiment may readily be practiced by those skilled in the art, while still remaining within the scope of the invention.

The advantages of the present invention are apparent.

Viewing window 110 occupies substantially all of one surface of display chamber 302. Because of the multiple reflections 308' of object 308, and because of the large size of viewing window 110, an observer may view the object or its reflections from a wide variety of angles. This is in distinct contrast to the "peepholes" present in many amusement or display devices known in the art.

As a further example of the advantages of the invention, the ability of observers to move their heads along a continuous path allows the "sparkle" of displayed jewelry to be fully appreciated. Also, because of the large size of the viewing window, several people can view an object at once, a feature which is desirable in commercial or museum settings.

Further, the provision of upper and/or lower chambers 304, 306 allows a variety of optional features to be implemented. For example, the object may be placed on a rotating platform, with the required rotational mechanism disposed within one of the upper or lower chambers.

The present invention allows all of these advantages, while further providing a protected environment for objects 308 which may be of substantial value, such as jewelry, art work, or collectibles. Of course, locking systems more secure than a simple key lock 106 lie within the contemplation of the invention.

By virtue of the use of two or more reflective surfaces 202, 204 in the cabinet, the apparent volume occupied by the display chamber is much larger than the actual volume it occupies. This provides the advantage of physical compactness, allowing minimal floor space to support a visually pleasing display.

All of these advantages are provided in a cabinet in which the observer may view the object from any given number of angles, without having to see his own reflection.

The cabinet according to the present invention may be used in a wide variety of environments. The cabinet is especially useful for museums, art galleries, showrooms of retail stores, and other public display areas. The cabinet is especially useful for showing jewelry or other valuable items such as art work or collectibles. The cabinet also has scientific uses, such as permitting photography of certain subjects from a variety of angles, including during use of time-lapse photography so that the object may simultaneously recorded from a variety of points in both time and space.

As demonstrated above, modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A display cabinet for the display of an object contained therein, the display cabinet comprising:

a) display chamber means for containing the object, the display chamber means being substantially defined by:

1) a plurality of internal reflective surfaces; and 2) a surface having a semi-reflective coating constituting:

i) means for making the object visible to one or more observers through the surface; and ii) means for preventing formation of a visible reflection of the one or more observers in the surface having the semi-reflective coating or in the plurality of reflective surfaces;

wherein:

the reflective surfaces are arranged at angles with respect to each other and in physical relation to the surface having the semi-reflective coating to define the display chamber means so that:

1) the object may be simultaneously viewed from different angles through the surface with the semi-reflective coating, as if the object were free-standing and not enclosed; and 2) an amount of floor space required for thus viewing the object from the different angles through the surface with the semi-reflective coating, is substantially less than that floor space which would be required if the object were free-standing and directly viewed from the different angles.

2. The display cabinet of claim 1, wherein:

the reflective surfaces are two in number, and, in conjunction with the surface have the semi-reflective coating, define the display chamber means, the display chamber means being substantially triangular.

3. The display cabinet of claim 1, further comprising:

at least one lighting means for illuminating an object to be displayed within the display chamber means; and a divider separating each lighting means from the object to be displayed, the divider forming a further surface of the display chamber means.

4. The display cabinet of claim 1, further comprising:

an upper chamber and a lower chamber respectively disposed above and below the display chamber means, each of the upper and lower chambers including lighting means for illuminating the object through respective upper and lower dividers.

5. The display cabinet of claim 4, wherein:

the lower chamber includes storage space.

6. The display cabinet of claim 1, further comprising a door, wherein:

the surface having the semi-reflective coating is located in the door, the door being movably affixed to the cabinet.

7. The display cabinet of claim 6, further comprising:

locking means for locking the door in a closed position.

8. A display cabinet for the display of an object contained therein, the display cabinet comprising:

a) at least one internal reflective surface;

b) a viewing window having a semi-reflective coating, the viewing window being large enough to allow plural observers to view the object simultaneously, the at least one internal reflective surface and the viewing window having the semi-reflective coating substantially forming a display chamber means for containing the object; and c) at least one lighting means, disposed outside the display chamber means, for illuminating the object to be displayed, wherein the lighting means is constructed such that:

1) when fully turned on, the lighting means provides light in the chamber of an intensity greater than light outside the cabinet so as to illuminate the object to make it visible to the observers through the viewing window while preventing the outside observers' images from being reflected back to the observers by the viewing window; and 2) when the lighting means is fully turned off, the arrangement of the at least one internal reflective surface and the viewing window causes the display chamber means and the object contained therein to be substantially blocked from the observers' view by the viewing window's semi-reflective coating.

9. The display cabinet of claim 8, wherein:

the at least one internal reflective surface comprises reflective surface, and, in conjunction with the surface have the semi-reflective coating, define the display chamber means, the display chamber means being substantially triangular.

10. The display cabinet of claim 8, further comprising:

a divider separating each lighting means from the object to be displayed, the divider forming a further surface of the display chamber means.

11. The display cabinet of claim 8, further comprising:

an upper chamber and a lower chamber respectively disposed above and below the display chamber means, each of the upper and lower chambers including lighting means for illuminating the object through respective upper and lower dividers.

12. The display cabinet of claim 11, wherein:

the lower chamber includes storage space.

13. The display cabinet of claim 8, further comprising a door, wherein:

the viewing window having the semi-reflective coating is located in a door, the door being movably affixed to the cabinet.

14. The display cabinet of claim 13, further comprising:

locking means for locking the door in a closed position.

* * * * *